US011035112B2

(12) United States Patent
Marr

(10) Patent No.: US 11,035,112 B2
(45) Date of Patent: Jun. 15, 2021

(54) WASTEWATER DISCHARGE METHOD AND SYSTEM

(71) Applicant: Banner Environmental Engineering Consultants Ltd., Black Diamond (CA)

(72) Inventor: James Marr, Black Diamond (CA)

(73) Assignee: Banner Environmental Engineering Consultants Ltd., Black Diamond (CA)

( * ) Notice: Subject to any disclaimer, the term of this patent is extended or adjusted under 35 U.S.C. 154(b) by 0 days.

(21) Appl. No.: 16/271,763

(22) Filed: Feb. 8, 2019

(65) Prior Publication Data

US 2020/0011045 A1 Jan. 9, 2020

Related U.S. Application Data

(63) Continuation of application No. 14/228,950, filed on Mar. 28, 2014, now abandoned.

(60) Provisional application No. 61/806,122, filed on Mar. 28, 2013.

(51) Int. Cl.

| | |
|---|---|
| ***E02B 13/00*** | (2006.01) |
| ***C02F 3/04*** | (2006.01) |
| ***E03F 1/00*** | (2006.01) |

(52) U.S. Cl.

CPC ..... *E03F 1/002* (2013.01)

(58) Field of Classification Search

CPC ..... A01G 25/02; A01G 25/06; E03F 1/002; E02B 13/00; E02B 11/005; C02F 3/046

USPC ..... 405/43, 44, 45, 49; 210/170.08; 33/415

See application file for complete search history.

(56) References Cited

U.S. PATENT DOCUMENTS

| | | | |
|---|---|---|---|
| 2,523,255 | A | 9/1950 | Coleman |
| 4,423,838 | A | 1/1984 | Dinur |
| 5,360,556 | A | 11/1994 | Ball et al. |
| 7,004,677 | B1 | 2/2006 | Ericksen et al. |
| 7,022,235 | B2 | 4/2006 | Hassett |
| 7,337,983 | B1 | 3/2008 | Boice |
| 7,857,545 | B2 | 12/2010 | Burnham |
| 8,010,329 | B2 | 8/2011 | Kallenbach |
| 2008/0073259 | A1 | 3/2008 | Potts |
| 2010/0327084 | A1 | 12/2010 | Boice, Jr. |

OTHER PUBLICATIONS

Orifice Flow Calculations by the McNally Institute, 1986 S. Belcher Rd., Clearwater, Florida 33764 http://www.mcnallyinstitute.com/13-html/13-12.htm; Jul. 11, 2000 (6 pages).

*Primary Examiner* — Benjamin F Fiorello
*Assistant Examiner* — Stacy N Lawson
(74) *Attorney, Agent, or Firm* — Ferguson Braswell Fraser Kubasta PC

(57) ABSTRACT

The present application provides a method and system for disposing wastewater effluent through laterals placed over a drain field without the need to level the terrain. The method provides calculating sizes of one or more orifices in positioned along the length of the laterals.

12 Claims, 4 Drawing Sheets

Example Calc:

Step 1:

Assume Field is to operate:

- @ 30 Imp Gal / min
- Has a 30' long x 2" diameter lateral
- Has 3 discharge Orifices @ 10' 20' and 30' = 10 ImpGPM / hole desired discharge

| Hole | Distance | Elevation (measured via string line or other) |
|---|---|---|
| 0 | 0 | 0 |
| 1 | 10 | -4' |
| 2 | 20 | +4' |
| 3 | 30 | -10' |

Step 2:

Select initial design pressure @ beginning of line = 29' of $H_20$

Step 3:

Calculate parameters

Hole 1

Calculate discharge pressure =

Initial pressure ($P_{int}$) + pressure due to elevation change (+ $\Delta P_E$)
- pressure due to friction loss ((+ $\Delta P_{FL}$)

$= P_{int} + \Delta P_E - \Delta P_{FL} = 29' + 4'$ (-.26') → Calculated using Hazen Williams or other @30 IMPGPM = 32.74' discharge pressure

FIGURE 3

Calculate hole size for selected discharge flow rate:

$$\text{Orifice size} = \sqrt{\frac{\text{discharge flow rate}}{16.37 \text{ X } 0.6 \text{ X } (P_{discharge})^{0.5}}}$$

$$= \sqrt{\frac{10 \text{ ImpGPM}}{16.37 \text{ X } 0.6 \text{ X } (32.74)^{0.5}}}$$

=0.422" round to nearest drill bit size =24/64" and recalc flow rate = 10 ImpGPM

Hole 2

$P_{discharge} = P_{int} + \Delta P_E - \Delta P_{fl}$ = 32.74 + (-4-4) – 0.12 → Calculated using Hazen Williams or other @(30-10=20 ImpGPM)
= 24.62

$$\text{Orifice size} = \sqrt{\frac{10 \text{ ImpGPM}}{16.37 \text{ X } 0.6 \text{ X } (24.63)^{0.5}}}$$

= 0.453" round to nearest drill bit size = 29/64" ; recalc flow rate = 10.01 ImpGPM

Hole 3

$P_{discharge} = P_{int} + \Delta P_E - \Delta P_{fl}$ = 24.62 + (4 + 10) – 0.03 → Calculated using Hazen Williams or other @(20-10.01=9.99 ImpGPM)
= 38.59

$$\text{Orifice size} = \sqrt{\frac{9.99 \text{ ImpGPM}}{16.37 \text{ X } 0.6 \text{ X } (38.59)^{0.5}}}$$

= 0.405" round to nearest drill bit size = 13/32"; recalc flow rate = 9.70 ImpGPM

FIGURE 4

WASTEWATER DISCHARGE METHOD AND SYSTEM

CROSS-REFERENCE TO RELATED APPLICATIONS

The present application claims priority to U.S. Patent Application Ser. No. 61/806,122 filed Mar. 28, 2013, the entire contents of which are herein incorporated by reference.

FIELD OF THE INVENTION

The present application pertains to the field of wastewater treatment and discharge. More particularly, the present application relates to a method and system of disposing wastewater over a terrain, particularly an uneven terrain.

BACKGROUND

After processing, wastewater effluent is removed from waste treatment facilities and is often applied or disposed of in drainage field systems called mounds or tile fields. In these systems, the rate of application is engineered carefully so the consumption rates of the soils in the local environment are not exceeded. Exceeding these rates may result in excessive pooling which can dramatically alter the local ecology of the micro ecosystem. Engineers typically determine the defensive capability of the proposed lands, and wastewater effluent rates are applied such that the local ecology is preserved. In this manner, the wastewater effluent is applied in a net beneficial impact to the local ecology.

Typically, lines of tubing such as those referred to as laterals, are used to transport the wastewater away from the facility. Typically, the laterals are placed on the ground and stretch for distances in the order of hundreds of feet. Openings (orifices) are strategically placed along the laterals to disperse the wastewater and allow the effluent to beneficially percolate into the soil and sub soils. These types of system designs are very effective at purifying the wastewater effluent and, when applied properly, provide a beneficial uptake by the environment. However, due to environmental and cost limitations, these types of designs are generally limited to small residential dwellings or facilities with relatively low sewage flow conditions.

In conventional tile field or mound designs, disposal and avoidance of fluctuations in the released flow of the wastewater from each orifice to ensure the release wastewater is spread evenly over the length of the lateral is facilitated by levelling off the terrain where the laterals are placed. This often requires dramatically altering the local ecology at a significant capital cost and net damage or alteration to the local micro-ecology.

Methods of disposing of wastewater are known in the art. Examples include U.S. Pat. No. 8,010,329 to Kallenbach, U.S. Pat. No. 5,360,556 to Ball, U.S. Pat. No. 7,022,235 to Hassett and U.S. Pat. No. 7,857,545 to Burcham.

There is a need to dispose of effluent while causing minimal structural damage to the environment using a low cost solution. This includes disposing wastewater in a field having uneven terrain, while still maintaining even flow dispersal of wastewater over large lateral distances.

This background information is provided for the purpose of making known information believed by the applicant to be of possible relevance to the present invention. No admission is necessarily intended, nor should be construed, that any of the preceding information constitutes prior art against the present invention.

SUMMARY

An object of the present invention is to provide a wastewater discharge system.

In accordance with one aspect of the present invention there is provided a method of disposing wastewater over a drain field comprising the steps of a) providing a wastewater effluent to one or more laterals; b) providing a datum string line over a portion of the drain field, the datum string line extending from a first end of one of the one or more laterals to a second end; c) measuring a first distance between the datum string line and a first of a plurality of points on the one or more laterals therebeneath; d) measuring a second distance between the datum string line and a second of the plurality of points on the lateral therebeneath; e) calculating a difference between the first distance and the second distance to determine a ΔD; f) calculating a discharge pressure at an orifice in the lateral at the first distance based on the ΔD; g) calculating a size of an orifice at the second of the plurality of points based on the discharge pressure; and h) providing an orifice at each of the plurality of distances along the lateral, such that the wastewater is disposed over the drain field through the orifices along the lateral.

In one embodiment, the method comprises the steps of: a) providing a wastewater effluent to one or more laterals; b) providing a datum string line over a portion of the drain field, the datum string line extending from a first end of one of the one or more laterals to a second end; c) measuring a first distance between the datum string line and a first of a plurality of points on the lateral therebeneath; d) measuring a second distance between the datum string line and a second of the plurality of points on the lateral therebeneath; e) calculating a difference between the first distance and the second distance to determine a ΔD using the formula:

$$\Delta D = D^* - Di \tag{1}$$

where D* is the distance between the datum string line and the lateral at the first end of the lateral and Di is the second distance; f) calculating a discharge pressure at an orifice in the lateral at the first distance using the following formula:

$$P_{discharge} = P_{int} + \Delta P_e - \Delta P_{fl} \tag{2}$$

where $P_{discharge}$ is the discharge pressure at the orifice, $P_{int}$ is the initial pressure or, if at a second or subsequent distance, the pressure at the preceding distance, $\Delta P_e$ is the change in pressure due to elevation change (which is the same magnitude as and inverse to ΔD, above) and $\Delta P_{fl}$ is the pressure due to friction loss;

g) calculating a size of an orifice at the second of the plurality of points using the following formula:

$$\text{orifice size} = \sqrt{\frac{\text{discharge flow rate}}{16.37 \times 0.6 \times (P_{discharge})^{0.5}}} \tag{3}$$

where orifice size is in inches, discharge flow rate is a desired discharge flow rate in Imperial gallons per minute at a given orifice, and $P_{discharge}$ is the discharge pressure at the orifice in feet; and h) providing an orifice at each of the plurality of distances along the lateral, such that the wastewater is disposed over the drain field through the orifices.

In accordance with another aspect of the invention, there is provided a system for disposing effluent wastewater from a wastewater effluent line comprising one or more laterals connected to said wastewater effluent line, the laterals comprising orifices determined as described according to the method herein.

This approach has gained general acceptance by regulators, design engineers, installers/contractors and the home owners because of the past inability to otherwise properly control the even volumetric dispersal of the wastewater along the lateral through the lateral orifices due to changes/variations in ground elevation.

BRIEF DESCRIPTION OF THE FIGURES

For a better understanding of the present invention, as well as other aspects and further features thereof, reference is made to the following description which is to be used in conjunction with the accompanying drawings, where:

FIG. 3 illustrates an exemplary calculation of determining pressures.

FIG. 4 illustrates an exemplary calculation of determining orifice sizes.

DETAILED DESCRIPTION

Figure 1:
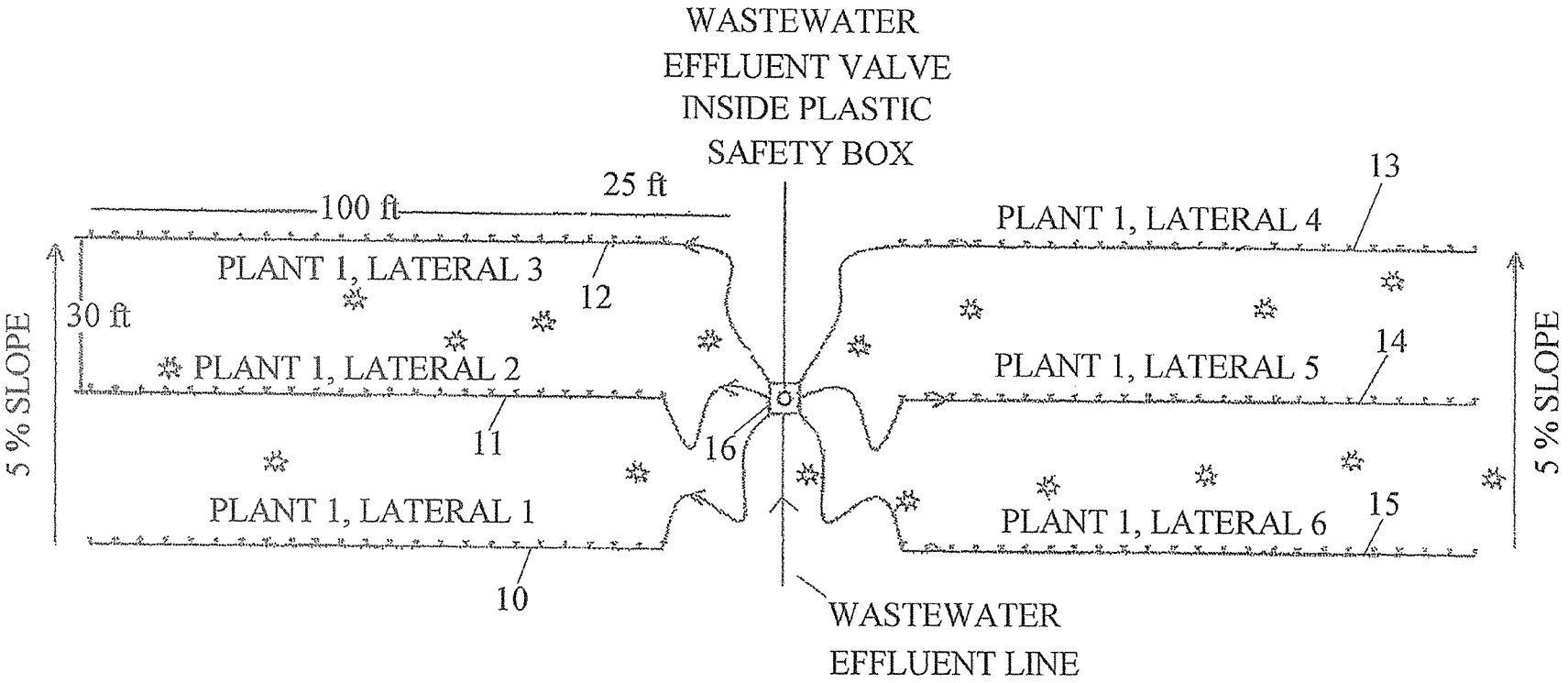
FIG. 1 shows a top view of the drain field with laterals present.

Unless defined otherwise, all technical and scientific terms used herein have the same meaning as commonly understood by one of ordinary skill in the art to which this invention belongs.

As used in the specification and claims, the singular forms "a", "an" and "the" include plural references unless the context clearly dictates otherwise.

The term "comprising" as used herein will be understood to mean that the list following is non-exhaustive and may or may not include any other additional suitable items, for example one or more further feature(s), component(s) and/or ingredient(s) as appropriate.

The present string line technology seeks to optimize the removal of wastewater effluent. In particular, the technology takes into account the lay of the landscape and allows for differences in elevation, without the requirement of levelling the terrain. This provides a significant advantage in cost savings and protecting the environment because the need to remove trees and other obstacles in the drain field is reduced. Further, there is no need to level the terrain by digging and otherwise upsetting the natural landscape.

The laterals are placed over the terrain and take into account the rises and falls of elevation. Six or more laterals may be used with any given effluent line, and each lateral contains a plurality of orifices sized based on their position in the elevation. The engineering of the orifice sizing, spacing and number of orifices are field determined based on the "datum string line" measurement, as outlined below.

To determine Di values, measurements are taken along the string line path. A datum string line is installed across the stretch of terrain over the top of the path of a dispersion lateral which the field engineer has strategically placed over the terrain directly on the surface of the area proposed for effluent dispersion. The elevation differences measured along the path of the datum string line (D*) and dispersion lateral, which is typically hundreds of feet or more, are recorded usually at an interval of about every three feet. The measurement locations are marked on the lateral for future reference and for drilling of the dispersion holes. The many measurements collected during the process create "elevation adjustment factors" for every 3 foot interval along the length of the lateral. Generally, for lower elevations, orifice sizes are smaller; for higher elevations, the orifice is larger.

In operation, the wastewater effluent line sends wastewater to a wastewater effluent valve in a centrally located box from which the laterals emerge. Wastewater flows through the laterals and is dispersed across the drain field through the orifices depending on the pressure, length, etc. Typically, the number of laterals is determined based on the population being served and size of the field.

The wastewater system as described herein can be organized in a number of different ways to accommodate different amounts of effluent being processed.

Stages of System Implementation

1) Planning: This includes an assessment of site conditions, general topography, watershed characterization and sensitivities, ecological considerations, site factors, and camp factors (population, style of camp).

2) Surveying and Soil Sample Collection: This includes a detailed investigation to size and select field area; information from planning is used together to develop/finalize design submission for AESRD. The soil collection provides the user with information on how the wastewater will be distributed in the environment. For example, sandy soil absorbs water more than clay soil.

3) Installation of Valve box and Laying of pipes.

4) Physical installation of the system: Pipes are premarked at the required hole intervals in advance or after the pipe lateral is installed.

5) Installation of String Line or Survey Set Up: Depending upon site foliage conditions either a string line or survey equipment is used to collect the differential topographical information. Both require the establishment of survey monuments or data for each lateral from which the differential elevation changes are measured at each hole (orifice) location. Hole spacing is dependent upon the detailed design aspects selected/developed from above but is typically about 3 feet.

For heavily treed or forested areas, a string line can be used effectively. The string, such as a carpenter's string, can be pulled taut, and a string line level is used to level the string between each section and before the string line is tied off. As the field engineer traverses through the forest he/she attaches the string from tree to tree as the lateral passes through the forest being careful to level the string between each section of string. If high quality carpenter's string is used, levelling sections can vary from 20 to 50 feet depending upon the way the lateral traverses the landscape. Some very minor trimming of tree branches may be required to be sure the string line does not touch any branches.

Once the string line is set, it is ready for measurements. If dramatic drops or increases in elevation are encountered in the field, the string line may need to be dropped or raised to allow for easy levelling or to avoid the string hitting the ground. When this occurs, the string is offset a few feet and an adjustment to the datum elevation is noted at this location for calculation purposes.

Similarly, for areas such as grasslands or low lying bush, a builders level and rod or laser level is used to measure the elevation distance between the lateral and datum. When the level is used the field data collection below is combined into this stage of the process. The measurements allow for the detailed hydraulic or topographical profile of that specific lateral to be generated and used in the hole sizing computations.

6) Field data Collection: Critical field data collected includes the elevation variations, usually every 3 feet interval which is the basic design. Measurements are collected from the string line to the lateral and the differentials are used to generate the detailed hydraulic or topographical profile of that specific lateral to be generated and used in the hole sizing computations.

7) Drilling of orifices and installation of orifice shields: Once the hole (orifice) sizing is complete, the field engineer goes back to the field and drills each hole as per the computations. Holes size variations can include 3 to 5 different sizes depending upon the topographical changes.

8) Installation of Peat Moss and heat trace: Once all the holes are drilled and orifice shields installed, the heat trace is pulled inside the pipe and the lateral is insulated with peat moss and locally acceptable grass seed. Very specific engineering calculations have allowed for determining the appropriate depth of peat moss to use to ensure the laterals do not freeze during extreme weather conditions and low flow period (low camp population).

9) Commissioning of the system: Commissioning involves setting the valves at the valve box and the first stage of the lateral to ensure that the correct inlet pressure (in feet of head) can be observed at specific locations in the lateral. The engineering calculations reveal the expected pressure anywhere allow the lateral so the field engineer can confirm performance of the lateral at pre-determined locations based upon the calculations. Usually the field engineer does the calculations as well as drills the holes.

To gain a better understanding of the invention described herein, the following example is set forth. It should be understood that the example is for illustrative purposes only. Therefore, it should not limit the scope of this invention in any way.

EXAMPLE

FIG. 1 shows a top view of an arrangement of laterals across an exemplary drain field. In this example, 6 laterals (10-15) are shown. The laterals extend from a wastewater effluent control box 16 which controls the distribution of effluent from the supply line to each of the laterals. Using methods known to the skilled person, the wastewater is dispersed at periodic intervals to each of the laterals. It is important to control the amount of head pressure for each lateral, based on its elevation and topography. This ensures even distribution of the wastewater effluent through each of the laterals and, ultimately, over the drain field.

Figure 2:
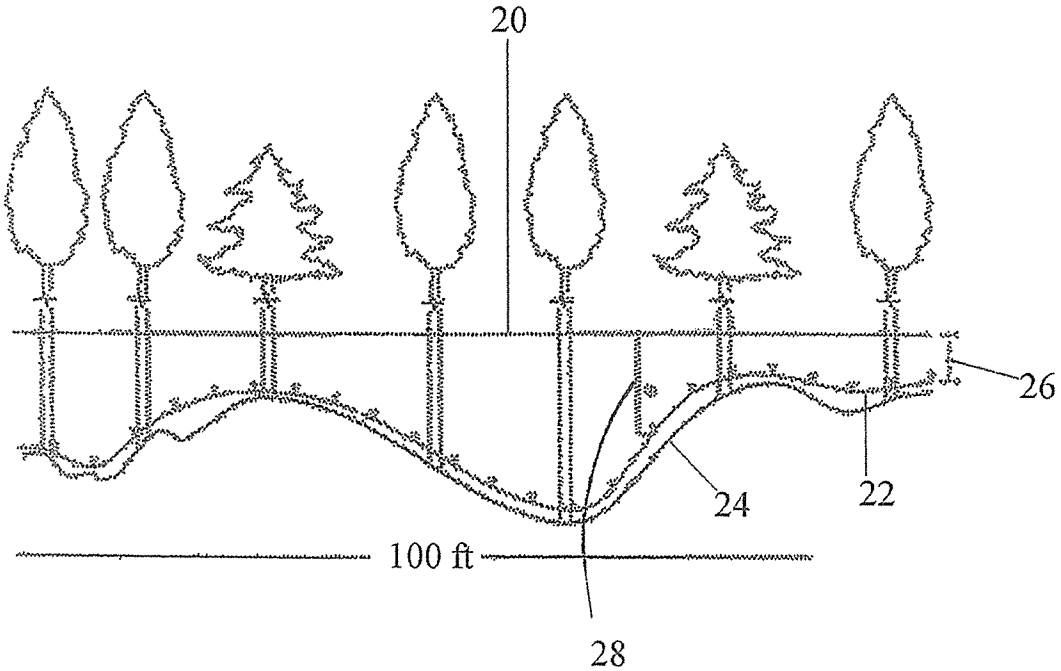
FIG. 2 shows the placement of a string line and lateral over an exemplary landscape.

FIG. 2 shows a side view of the datum string line 20 extending above a lateral 22, which is positioned along the contour of the terrain 24. The string line 20 is essentially a string or rope which is attached to a fixed structure (such as to a nail on a post or a tree, for example) at a first end of the lateral. The string is then pulled taut and stretched over the terrain where the lateral lies. The string line thus passes over the length of the lateral from the fixed structure at the first end of the lateral to a fixed structure at the second end of the lateral (not shown). Typically, the distance from the string line to the first end of the lateral is approximately 36 inches; however, other suitable distances above the first end of the lateral may be contemplated.

The distance between the string line and the lateral at the first end of the lateral is termed D* (26). Then, at each orifice, the distance between the string line and the lateral is measured. The distance from the string line to the lateral at each orifice is termed Di (28). Once all measurements have been made, a value of ΔD is calculated as:

$$\Delta D = D^* - Di \quad (1).$$

In the example shown in FIGS. 3 and 4, three measurements of Di are taken at holes (orifices) 0 (corresponding to the first end of the string line), 1, 2 and 3, at distance marks of 0, 10, 20 and 30 feet, respectively, from the first end of the lateral along the length thereof. The elevation values at the orifices at 10, 20 and 30 feet are −4', +4' and −10', respectively. These values are then entered in the above equation, (1).

Next, an initial water pressure is selected at the first end of the lateral. In the present example, the initial pressure is set at 29'. As water pressure fluctuates along the length of the lateral, and due to the changes in elevation, adjustments are required to compensate for those changes. The discharge pressure is determined by adding the initial pressure ($P_{int}$) to the change in pressure due to elevation change ($\Delta P_e$)—which is the same magnitude as and inverse to ΔD above, expressed in feet of pressure—less the pressure due to friction loss ($\Delta P_{fl}$), calculated using Hazen Williams.

$$P_{discharge} = P_{int} + \Delta P_e - \Delta P_{fl} \quad (2)$$

Thus, at hole #1, the discharge pressure is 29'+4'−0.26'=32.74'.

To calculate the orifice size, the following calculation is made:

$$\text{orifice size} = \sqrt{\frac{\text{discharge flow rate}}{16.37 \times 0.6 \times (P_{discharge})^{0.5}}} \quad (3)$$

Using the desired discharge flow rate of 10 ImpGal/min, and the discharge pressure ($P_{discharge}$) of 32.74' as calculated above, an orifice size of 0.422" is determined. This is then rounded to the nearest drill bit size of 24/64" and an orifice of this size is made in the lateral at the 10' mark. The discharge flow rate is adjusted accordingly depending on the size of the orifice. Further, initial pressure can be adjusted and calculations repeated to bring the target flow rate at the second end of the lateral to zero.

Orifice sizes are then calculated for the remaining exemplary orifices as summarized in FIG. 1. Each subsequent orifice is calculated based on the values of the orifice immediately preceding it. For example, the second orifice is calculated using the difference in elevation between it and the first orifice, and the $P_{int}$ in equation (2) is based on that obtained for the first orifice.

In particular embodiments, these calculations are repeated over and over again using a computer program specially written to allow the calculated hole sizes at each measurement location to vary until the series of hole sizes is optimized. The field engineer selects the optimization parameters by setting the computer program parameters. These include the total dispersion flow rate required, the total number of orifices planned for along the lateral (all equally spaced) the length of the lateral, the diameter of the lateral, and the allowable variation in hole size. The drill bit sizing parameter has been established in the program to match commercially available drill bit sizes. The field engineer enters the "elevation adjustment factors" which was measured from the datum string line installation and operates the computer program until the individual variations in flow from the series of holes along the lateral is minimized.

When the minimum is determined, the list is printed off and the holes can be drilled into the lateral with their respective hole sizes. By this method, the effluent is equally dispersed over the entire length of the lateral despite the natural variations in the elevation of the natural terrain. This eliminates unwanted wastewater effluent pooling, uneven dispersion and allows for longer laterals to be used.

All publications, patents and patent applications mentioned in this Specification are indicative of the level of skill of those skilled in the art to which this invention pertains and are herein incorporated by reference to the same extent as if each individual publication, patent, or patent applications was specifically and individually indicated to be incorporated by reference.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The embodiments of the invention in which an exclusive property or privilege is claimed are defined as follows:

1. A method of disposing wastewater effluent over the natural landscape of a drain field, the method comprising the steps of:

a) providing one or more laterals over a portion of the drain field, wherein the portion of the drain field comprises a forested area comprising a plurality of trees;

b) providing a datum string line over a selected lateral of the one or more laterals, the datum string line extending from a first end of the selected lateral to a second end of the same lateral, wherein the selected lateral of the one or more laterals passes through the forested area, and wherein providing the datum string line further comprises attaching the datum string line from tree to tree to form a plurality of points of attachment of the datum string line as the selected lateral of the one or more laterals passes through the forested area;

c) measuring a distance between the datum string line and the first end of the selected lateral which lies beneath the datum string line, and selecting an initial water pressure at the first end of the selected lateral;

d) measuring a first distance between the datum string line and a first point position of a plurality of points on the selected lateral which lies beneath the datum string line;

e) measuring a second distance between the datum string line and a second point position of the plurality of points on the selected lateral;

f) calculating a difference between the first distance and the distance between the datum string line and the first end of the selected lateral which lies beneath the datum string line to determine a $\Delta D$;

g) calculating a discharge pressure at the first of the plurality of points based on the $\Delta D$, calculating a required size of a first orifice to be added at the first point, and providing the first orifice at the first point;

h) calculating a required size of a second orifice to be added and providing said second orifice at the second of the plurality of points based on a calculated discharge pressure at the second of the plurality of points;

i) calculating a required size of one or more further orifices and providing the one or more further orifices at one or more further of the plurality of points based on a calculated discharge pressure at the one or more further of the plurality of points;

j) repeating steps b) to i) for each additional lateral of the one or more laterals;

k) insulating and/or covering the one or more laterals; and l) providing a wastewater effluent at periodic intervals to each of the one or more laterals from the first end to the second end, such that the wastewater effluent is evenly disposed over the drain field through the orifices along each of the laterals.

2. The method of claim 1, wherein the discharge pressure at each of said orifices is the sum of an initial pressure through each lateral, and a change in pressure due to elevation change, less a pressure due to friction loss.

3. The method of claim 1, wherein the required size of each of said orifices is proportional to a discharge flow rate at respective said orifices.

4. The method of claim 1, wherein step (b) further comprises levelling the datum string line between each point of attachment.

5. The method of claim 4, wherein levelling the datum string line comprises utilizing a string line level.

6. The method of claim 1, wherein step (k) comprises insulating the one or more laterals, wherein insulating the one or more laterals comprises applying a layer of peat moss to the one or more laterals at a predetermined depth to ensure the one or more laterals do not freeze during extreme weather conditions and low flow period.

7. The method of claim 1, wherein one or more of calculating steps (g)-(i) are performed utilizing a computer program, said one or more of calculating steps (g)-(i) comprising:

inputting parameters into the computer program, the parameters comprising: a total dispersion flow rate required, a total number of orifices for each of the one or more laterals, a length of each of the one or more laterals, a diameter of each of the one or more laterals, an allowable variation in orifice size, and distance measurements between each of the datum string lines and each of the laterals lying therebeneath, the computer program being configured to optimize the required size of each of the orifices for each of the one or more laterals in order to minimize individual variations in flow from each of the orifices.

8. A method of disposing wastewater effluent over the natural landscape of a drain field, the method comprising the steps of:

a) providing one or more laterals over a portion of the drain field, wherein the portion of the drain field comprises a forested area comprising a plurality of trees;

b) providing a datum string line over a selected lateral of the one or more laterals, the datum string line extending from a first end of the selected lateral to a second end of the same lateral, wherein the selected lateral of the one or more laterals passes through the forested area, and wherein providing the datum string line further comprises attaching the datum string line from tree to tree to form a plurality of points of attachment of the datum string line as the selected lateral of the one or more laterals passes through the forested area;

c) measuring a distance between the datum string line and each of n consecutive points on the selected lateral which lies beneath the datum string line, wherein n is a positive integer and n=1 corresponds to a point at the first end of the selected lateral;

d) calculating a difference between a measured distance between the datum string line and a point n on the selected lateral and a measured distance between the datum string line and a point n−1 on the selected lateral to determine a ΔD using the formula:

$$\Delta D = D^* - Di \quad (1)$$

wherein

Di represents the measured distance between the datum string line and the point n on the selected lateral, and D* represents the measured distance between the datum string line and the point n−1 on the selected lateral, and when n=1 then D* is the distance between the datum string line and the point at the first end of the selected lateral;

e) calculating a discharge pressure at the point n, using the following formula:

$$P_{discharge} = P_{int} + \Delta P_e - \Delta P_{fl} \quad (2)$$

where $P_{discharge}$ is the discharge pressure at the point n, $P_{int}$ is an initial pressure at the point n−1 when n>1, wherein when n=1 then the initial pressure is a preselected water pressure at the first end of the selected lateral, $\Delta P_e$ is a change in pressure due to elevation change expressed in ΔD feet of pressure, and $\Delta P_{fl}$ is a pressure due to friction loss;

f) calculating a required size of each one of a plurality of orifices to be added to the n consecutive points, where n>1, using the following formula:

$$\text{orifice size} = \sqrt{\frac{\text{discharge flow rate}}{16.37 \times 0.6 \times (P_{discharge})^{0.5}}} \quad (3)$$

where discharge flow rate is a desired discharge flow rate at each one of the plurality of orifices, and providing one of said plurality of orifices to each of the n consecutive points, where n>1, on the selected lateral; and g) repeating steps b) to f) for each additional lateral of the one or more laterals;

h) insulating and/or covering the one or more laterals; and i) providing a wastewater effluent to each of the one or more laterals at periodic intervals, such that the wastewater effluent is evenly disposed over the drain field through the orifices along each of the laterals.

9. The method of claim 8, wherein step (b) further comprises levelling the datum string line between each point of attachment.

10. The method of claim 9, wherein levelling the datum string line comprises utilizing a string line level.

11. The method of claim 8, wherein step h) comprises insulating the one or more laterals, wherein insulating the one or more laterals comprises applying a layer of peat moss to the one or more laterals at a predetermined depth to ensure the one or more laterals do not freeze during extreme weather conditions and low flow period.

12. The method of claim 8, wherein one or more of calculating steps (e)-(f) are performed utilizing a computer program, said one or more of calculating steps (e)-(f) comprising:

inputting parameters into the computer program, the parameters comprising: a total dispersion flow rate required, a total number of orifices for each of the one or more laterals, a length of each of the one or more laterals, a diameter of each of the one or more laterals, an allowable variation in orifice size, and distance measurements between each of the datum string lines and each of the laterals lying therebeneath, the computer program being configured to optimize the required size of each of the orifices for each of the one or more laterals in order to minimize individual variations in flow from each of the orifices.

* * * * *